US005695264A

United States Patent [19]

Koch

[11] Patent Number: 5,695,264

[45] Date of Patent: Dec. 9, 1997

[54] PORTABLE OFFICE

[75] Inventor: David T. Koch, St. Louis, Mo.

[73] Assignees: Color Art Office Interiors, Inc.; Joseph Hunt; Joseph J. Steiner, all of St. Louis, Mo.

[21] Appl. No.: 693,898

[22] Filed: Aug. 5, 1996

[51] Int. Cl.[6] ..... A47B 88/00

[52] U.S. Cl. ..... 312/310; 312/314; 312/196; 312/239; 312/298; 108/38; 108/48

[58] Field of Search ..... 312/309, 310, 312/107, 235.3, 235.2, 237, 239, 240, 313, 314, 317.1, 317.3, 194, 195, 196, 245; 108/48, 166, 169, 35, 38

[56] References Cited

U.S. PATENT DOCUMENTS

| | | | |
|---|---|---|---|
| 1,678,378 | 7/1928 | Campbell | 108/38 |
| 1,900,793 | 3/1933 | Broughton | 312/235.3 X |
| 1,970,734 | 8/1934 | Buffelen | 108/38 |
| 2,445,164 | 7/1948 | Worthman | 108/38 X |
| 2,547,808 | 4/1951 | Burnage | 312/310 X |
| 2,649,349 | 8/1953 | Goodrich | 312/314 X |
| 2,692,812 | 10/1954 | Stahl | 312/310 |
| 2,755,156 | 7/1956 | Nichols | 312/309 X |
| 3,748,010 | 7/1973 | Garte | 312/314 |
| 4,155,609 | 5/1979 | Skafte et al. | 312/245 |
| 5,429,432 | 7/1995 | Johnson | 312/313 X |
| 5,536,080 | 7/1996 | Madimenos et al. | 312/196 X |
| 5,607,214 | 3/1997 | Pierce et al. | 312/310 |

OTHER PUBLICATIONS

OfficeMax advertisement for Ameriwood Furniture's Oak Armoire, #0113–6247.

OfficeMax advertisement for Ameriwood Furniture's Multimedia Armoire, #0113–4294.

National Chair and Furniture Co. advertisement for Homeworks—Sligh Home Office Furniture in the *St. Louis Business Journal*, p. 3B.

Advertisement for computer furniture and accessories, p. 60.

Steamer7.TGA, Photograph.

Tarrant Interiors' brochure on The Office™.

*Primary Examiner*—Jose V. Chen
*Assistant Examiner*—James O. Hansen
*Attorney, Agent, or Firm*—Armstrong, Teasdale, Schlafly & Davis

[57] ABSTRACT

A portable office unit has an enclosure including two hingedly connected shells. Each shell has a back, a top, opposing sides, and an open front. The shells are pivotable between a closed position in which the open fronts of the shells face each other, and a closed position in which the shells are in side by side relation, with the open fronts facing generally in the same direction. Each shell has a work surface mounted to swing between a vertical position in which the work surface extends generally vertically inside the shell, and a horizontal position in which the work surface extends generally horizontally from the open front of the shell.

20 Claims, 2 Drawing Sheets

PORTABLE OFFICE

BACKGROUND AND SUMMARY OF THE INVENTION

There are many situations where it is desirable to set up a temporary office. These include setting up management offices for temporary events, such as fairs, festivals, and concerts, and setting up claims offices after a disaster, such as a hurricane, tornado, or flood.

The present invention relates to an office unit that is easy to transport, and which can quickly and easily be set up to form an office with desk space and storage to set up a fully functioning office. Generally, the office unit of this invention comprises an enclosure comprising two hingedly connected shells. Each shell has a back, a top, opposing sides, and an open front. The shells are pivotable between a closed position, in which the open fronts of the shells face each other, and an open position in which the shells are in side by side relation, with the open fronts facing generally in the same direction. Each shell has a panel or work surface mounted therein to swing between a vertical position in which the work surface extends generally vertically inside the shell, and a horizontal position in which the work surface extends generally horizontally from the open front of the shell.

The office unit of the present invention is of simple and inexpensive construction. It is compact, and easy to transport. It can be quickly set up for use. The unit can be provided with storage so that papers, forms and supplies can be stored in the unit so that the office is ready for immediate use.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 6:
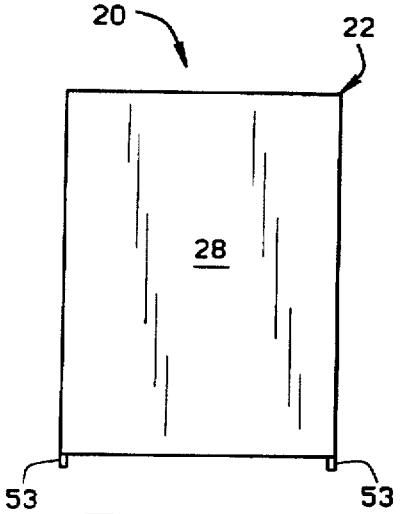
FIG. 6 is a front elevation view of the office unit in its closed position.
Figure 7:
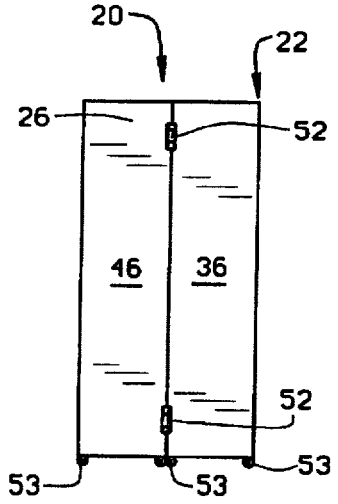
FIG. 7 is a side elevation view of the office unit in its closed position.
Figure 8:
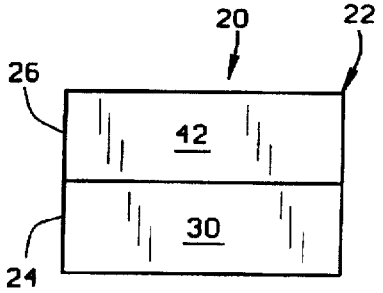
FIG. 8 is a top plan view of the office unit in its closed position.

An embodiment of a portable office unit constructed according to the principles of this invention is indicated generally as 20 in the Figures. The office unit 20 comprises an enclosure 22 which in turn comprises first and second shells 24 and 26. Shell 24 comprises a back 28, a top 30, a bottom 32, left and right sides 34 and 36, and an open front 38. Similarly, shell 26 comprises a back 40, a top 42, a bottom 44, left and right sides 46 and 48, and an open front 50. The shells 24 and 26 are hingedly connected with hinges 52 connecting the right side 36 of shell 24 with the left side 46 of shell 26, so that the shells pivot between a closed position (shown in FIGS. 6–8) in which the open fronts 38 and 50 face each other, and an open position (shown in FIGS. 1–5) in which the shells are positioned side-by-side, with the open fronts generally facing the same direction. There are are preferably rollers 53 on the bottoms of the shells 24 and 26 to facilitate moving the unit 20, and to facilitate the relative pivoting of the shells 24 and 26. Alternatively, the shells could be provided with leveler feet or glides.

Figure 1:
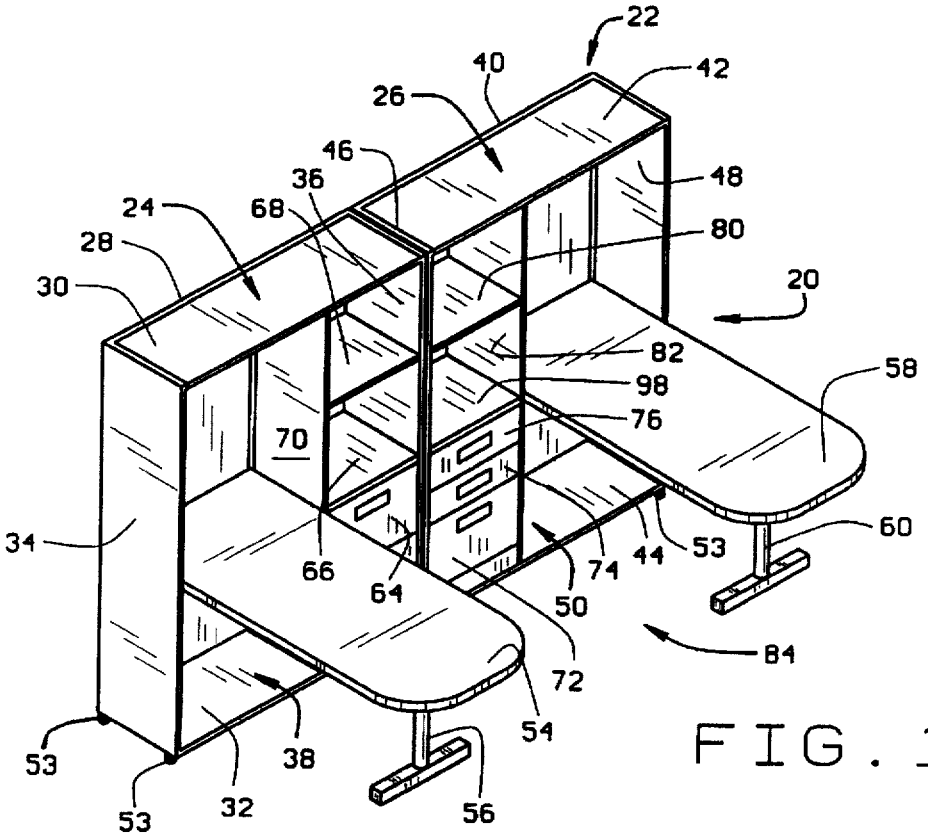
FIG. 1 is a perspective view of an embodiment of an office unit constructed according to the principles of this invention, shown in its open position.
Figure 2:
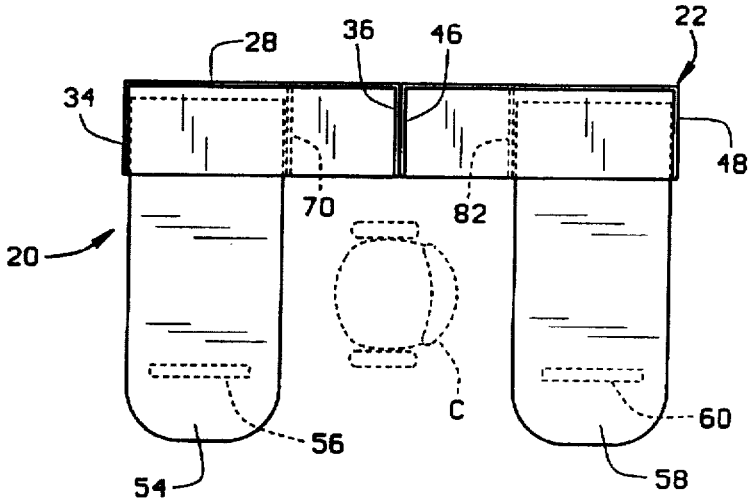
FIG. 2 is a top plan view of the office unit in its open position.
Figure 3:
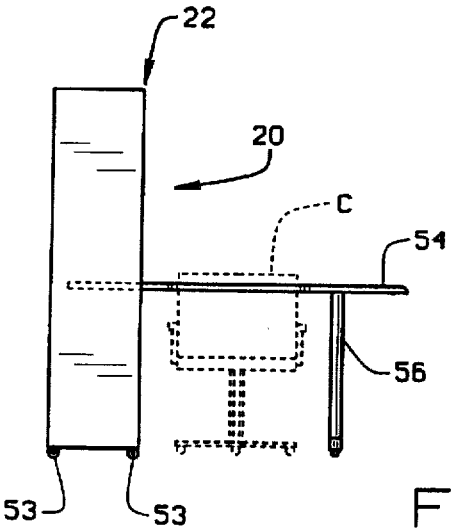
FIG. 3 is a left side elevation view of the office unit in its open position.
Figure 4:
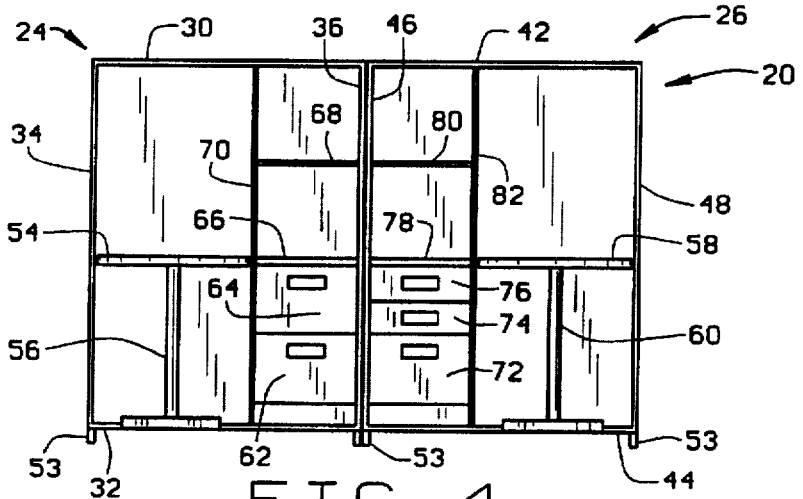
FIG. 4 is a front elevation view of the office unit in its open position, with the work surfaces in their horizontal position.
Figure 5:
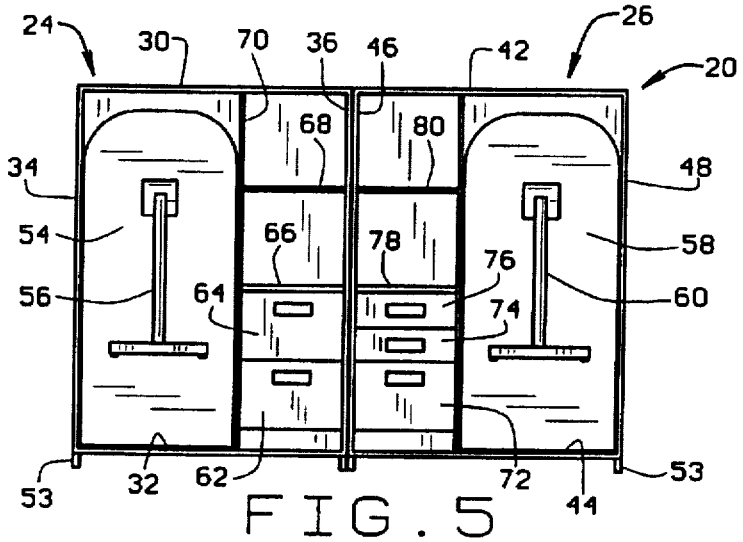
FIG. 5 is a front elevation view of the office unit in its open position, with the work surfaces in their vertical position.

A panel or work surface 54 is mounted in the shell 24 to pivot between a vertical position in which the work surface extends generally vertically inside the shell (as shown in FIG. 5), and a horizontal position in which the work surface extends generally horizontally from the open front 38 of the shell. There is a generally inverted T-shaped leg 56 hingedly mounted on the work surface 54 to swing out and support the work surface when the work surface is in its horizontal position. Of course the leg 56 could have some other configuration to support the work surface 54. Similarly, a panel or work surface 58 is mounted in the shell 26 to move between a vertical position and a horizontal position. There is a generally inverted T-shaped leg 60 hingedly mounted on the work surface 58 to swing out and support the work surface when the work surface is in its horizontal position. Of course, the leg could have some other configuration to support the work surface 58.

There are preferably a plurality of storage compartments formed in the shells. In this preferred embodiment these compartments include drawers 62 and 64 and shelves 66 and 68 arranged in a vertical column adjacent the right side 36 of the shell 24, separated from the work surface 54 with a vertical wall 70. These compartments also include drawers 72, 74, and 76, and shelves 78 and 80 in a vertical column adjacent the left side 46 of the shell 26, separated from the work surface 58 with a vertical wall 82.

OPERATION

In operation, the portable office 20 is transported to the site where it is needed. The enclosure 22 is opened, and the shells 24 and 26 are pivoted to their open position. The work surface 54 is moved from its vertical position to its horizontal position, extending from the open front 38 of the shell 24. As the work surface 54 moves to its horizontal position, the leg 56 swings out from the work surface to support the work surface. Similarly, the work surface 58 is moved from its vertical position to its horizontal position, extending from the open front 50 of the shell 26. As the work surface 58 moves to its horizontal position, the leg 60 swings out from the work surface to support the work surface. The work surfaces are separated by a work space large enough for a chair C. A user sitting in the work space has access to the drawers 62, 64, and 72, 74, and 76, and to the shelves 66, 68, 78, and 80. The drawers can be packed with appropriate supplies so that the office is ready to use.

When the need for the office is over, the work surfaces 54 and 58 are moved to their vertical positions, and the shells 24 and 26 moved to their closed position. The office unit 20 can then be stored or transported to the next site for use.

The office unit thus provides a simple, inexpensive way to provide temporary office facilities. The unit provides generous work surfaces and storage so that the unit can be fully stocked and ready for use.

What is claimed is:

1. A portable office unit comprising an enclosure comprising two hingedly connected shells, each shell having a back, a top, opposing sides, and an open front, the shells being pivotable between a closed position in which the open fronts of the shells face each other, and an open position in which the shells are in a side by side relation, with the open fronts facing generally in the same direction, each shell further having at least one storage compartment between a work surface and the hinged connection, the work surface spaced from the hinged connection and mounted to swing between a vertical position in which the work surface extends generally vertically inside the shell, and a horizontal position in which the work surface extends generally horizontally from the open front of the shell, the work surfaces, when in their horizontal positions, extending generally parallel to each other with a work space between them.

2. The portable office unit according to claim 1 wherein each shell is mounted on rollers.

3. The portable office unit according to claim 1 wherein said work surface width is greater than width of the storage compartment.

4. The portable office unit according to claim 1 wherein said storage compartment width is greater than the work surface width.

5. The portable office unit according to claim 1 wherein said storage compartment is placed adjacent to the hinged connection and located at a height above a horizontal plane of the work surface.

6. The portable office unit according to claim 1 wherein said storage compartment is placed adjacent to the hinged connection and located at a height below a horizontal plane of the work surface.

7. The portable office unit according to claim 1 wherein at least one of said storage compartments comprises at least one horizontally extending shelf.

8. The portable office unit according to claim 1 wherein at least one of said storage compartments comprises at least one drawer.

9. The portable office unit according to claim 1 wherein said work surface includes a hingedly attached leg for supporting work surface.

10. The portable office unit according to claim 1 wherein said leg is configured as an inverted T shape.

11. A portable office unit comprising an enclosure comprising two shells hingedly attached together, each shell having a back, a top, opposing sides, and an open front, the shells pivoting about the hinge between a closed position in which the open fronts of the shells face each other, and an open position in which the shells are side by side with their open fronts facing generally in the same direction; and a work surface and at least one storage compartment in each shell, the storage compartment positioned between the hinged connection and the work surface, the work surface spaced from the hinged connection, mounted to swing between a vertical position in which the work surface extends generally vertically inside the shell, and a horizontal position in which the work surface extends generally horizontally from the open front of the shell, the work surfaces, when in their horizontal positions, extending having a work space between them.

12. The portable office unit according to claim 11 wherein each shell is mounted on rollers.

13. The portable office unit according to claim 11 wherein said work surface width is greater than width of storage compartment.

14. The portable office unit according to claim 11 wherein said storage compartment width is greater than work surface width.

15. The portable office unit according to claim 11 wherein said storage compartment is placed adjacent to the hinged connection and located at a height above a horizontal plane of the work surface.

16. The portable office unit according to claim 11 wherein said storage compartment is placed adjacent to the hinged connection and located at a height below a horizontal plane of the work surface.

17. The portable office unit according to 11 claim wherein at least one of said storage compartments comprises at least one horizontally extending shelf.

18. The portable office unit according to claim 11 wherein at least one said storage compartments comprises at least one drawer.

19. The portable office unit according to claim 11 wherein said work surface includes a hingedly attached leg for supporting work surface.

20. The portable office unit according to claim 11 wherein said leg is configured as an inverted T shape.

* * * * *